United States Patent [19]

Kniep

[11] 4,375,927

[45] Mar. 8, 1983

[54] METHOD AND DEVICE FOR INTERMITTENTLY EXERTING FORCES ON SOIL

[75] Inventor: Joris Kniep, Oudenbosch, Netherlands

[73] Assignee: International Technische Handelsonderneming en Adviesbureau Itha B.V., Oudenbosch, Netherlands

[21] Appl. No.: 104,978

[22] Filed: Dec. 18, 1979

[30] Foreign Application Priority Data

Dec. 20, 1978 [NL] Netherlands ..... 7812372

[51] Int. Cl.[3] ..... E01C 19/38

[52] U.S. Cl. ..... 404/133; 173/49; 175/55; 74/61

[58] Field of Search ..... 404/133, 113, 116; 175/55; 74/61; 173/49

[56] References Cited

U.S. PATENT DOCUMENTS

| | | | |
|---|---|---|---|
| 2,054,851 | 9/1936 | Dornfeld | 404/133 |
| 2,169,468 | 8/1939 | McDougall | 404/133 X |
| 2,743,585 | 5/1956 | Berthet | 404/133 X |
| 2,748,750 | 6/1956 | Altschuler | 404/133 X |
| 2,975,761 | 3/1961 | Fairchild | 404/133 X |
| 3,240,134 | 3/1966 | McRae | 404/133 |
| 3,280,924 | 10/1966 | Pavlovich | 173/49 X |
| 3,394,766 | 7/1968 | Le Belle | 173/49 |
| 3,433,311 | 3/1969 | Le Belle | 175/55 X |
| 3,483,805 | 12/1969 | Hirn | 404/133 |
| 3,500,908 | 3/1970 | Barler | 173/49 X |
| 3,561,336 | 2/1971 | Century | 404/133 |
| 3,865,501 | 2/1975 | Kniep | 404/133 |
| 3,871,617 | 3/1975 | Majima | 404/133 X |

FOREIGN PATENT DOCUMENTS

| | | | |
|---|---|---|---|
| 796546 | 4/1936 | France | 404/133 |
| 966291 | 3/1948 | France | 404/133 |

*Primary Examiner*—Nile C. Byers, Jr.
*Attorney, Agent, or Firm*—Lewis H. Eslinger

[57] ABSTRACT

A method and a device for consolidating soil or driving a pile into the ground by thrusting forces transferred to the soil or the pile through a transmission ground foot, the forces being derived from at least two sources, viz. a mass load and a vibratory member, the latter of which is adapted to produce a varying vertical thrusting force and is adapted to be brought successively out of and, in a shock-like manner, into engagement with the transmission ground foot, with no buffering springs being disposed between the vibratory member and the ground foot.

23 Claims, 7 Drawing Figures

FIG. 4
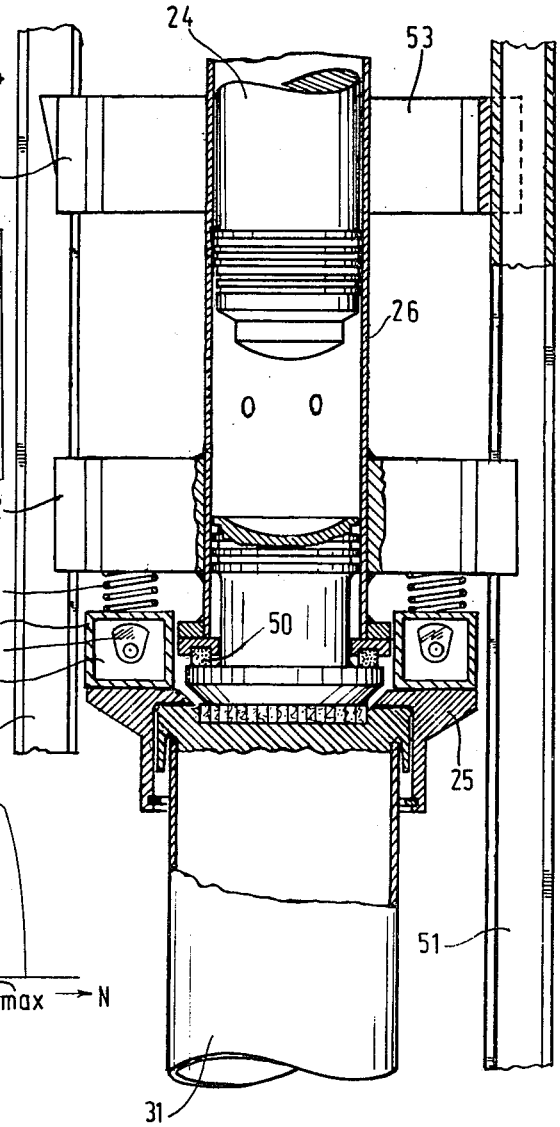
FIG. 4a
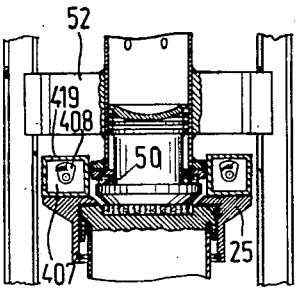
FIG. 6
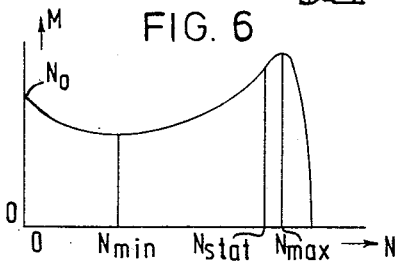
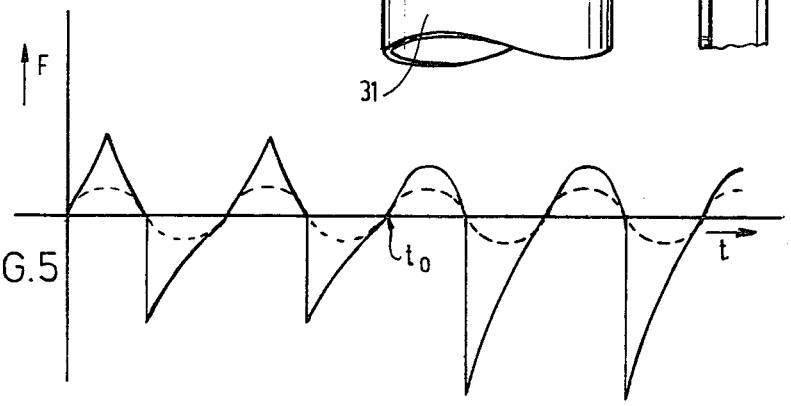
FIG.5

METHOD AND DEVICE FOR INTERMITTENTLY EXERTING FORCES ON SOIL

The invention relates to a method and device for intermittently exerting forces on soil by using at least one mass load and a force varying substantially periodically with time which is produced by at least one vibratory member movable up and down. Such a device is known from Dutch Patent Application No. 7415157 which has been laid open for public inspection. With this device the effect of transmitting forces applied to the soil does not provide satisfactory results.

The invention has for its object to provide an improvement in this respect and suggests a method of the kind set forth in which the vibratory member is brought successively out of and, in a shock-like manner, into engagement with the means transmitting the thrust forces to the soil.

It is advantageous to exert an additional striking force on the transmitting means.

In the method according to the invention, in which the vibratory member comprises a vibrating mass, the vibratory member can be caused, in the no-load state, to vibrate around a position of equilibrium when it is not in engagement with the transmission means, after which the vibratory member is successively brought out of and, in a shock-like manner, into engagement with the transmission means.

Very advantageous is the method in which all of the above-mentioned forces are transmitted via the transmission means and a pile to be driven into the soil. In this case under the action of an extremely rapid succession of thrusts the pile is driven into the soil which is continuously in a fluidized state.

The downward movement of the vibratory member can only take place under the action of its own weight. It is advantageous, however, to bring the vibratory member, in a shock-like manner, into engagement with the transmission means at least partly by spring means.

The invention furthermore relates to a device for carrying out the method according to the invention comprising transmission means transferring all forces to the soil, a mass providing the mass load on the transmission means and at least one vibratory member adapted to move up and down, the device being characterized in that the vibratory member can successively be brought out of and, in a shock-like manner, into engagement with the transmission means transferring the thrust forces to the soil.

Further features of the invention will now be described more fully with reference to the accompanying drawings.

FIG. 4 is an enlarged elevation, partly broken away view of the device shown in FIG. 3;

FIG. 4*a* is an elevation, partly broken away view of a modification of the device of FIG. 4;

FIG. 5 is a graph of the forces exerted by the device according to this invention on the soil as a function of time; and FIG. 6 is a graph of the torque characteristic of an electric motor for driving the vibratory member as a function of speed.

Figure 1:
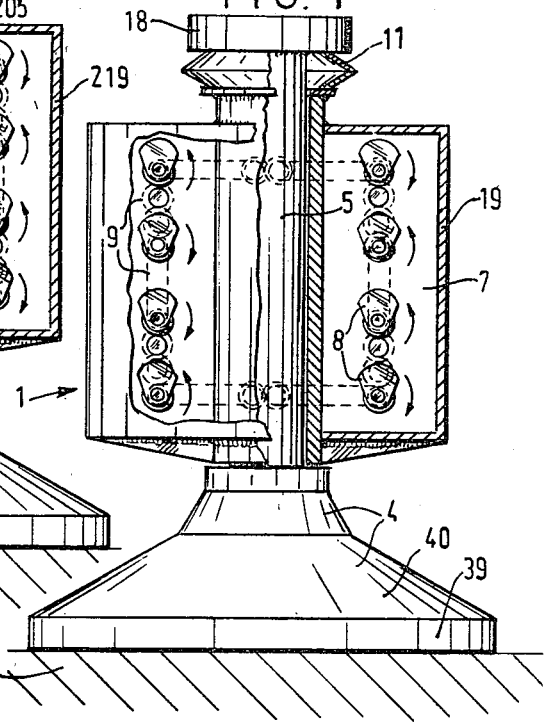
FIG. 1 is a side elevation partly broken away view of a device for consolidating soil in accordance with the invention.

The device 1 as shown in FIG. 1 comprises transmission means for transferring all forces to the soil 2 and is formed by a ground foot 40. The device 1 furthermore comprises a mass for exerting a mass load on the transmission means and is formed by the bulk of the ground foot 40 which consists of a heavy and thick ground plate 39 and a conical super structure 4. A column 5 stands above and is firmly connected with the ground foot 40. The top end of the column 5 has a collar 18 forming pushing-off means. The device 1 furthermore comprises a vibratory member 7, which can push off from the collar 18 in a vertical sense by means of two cup springs 11. The vibratory member 7 is successively brought out of and, in a shock-like manner, into engagement with the transmission means for transferring thrust forces to the soil when the transmission means is actuated.

The thrust forces are produced by the vibratory member 7 striking the ground foot 40 with the bulk of its housing 19. For producing the vibrations the vibratory member 7 comprises a vibratory mass consisting of a plurality of identical, eccentrically rotatable masses 8. Under the action of driving means 9 schematically indicated by broken lines, these masses 8 rotate in pairs with the masses 8 in each pair rotating in opposite directions, as indicated by the arrows, in a manner such that only a vertically directed alternating force is transferred via the ground foot 40 to the soil. The vibratory member 7 is urged towards the ground foot 40 both by its own weight and by the cup springs 11.

The column 5 on the ground plate 40 conducts and is surrounded by the housing 19 having the eccentrically rotatable masses 8 and the vibratory member 7, the lower end of which vibratory member can be successively brought out of and, in a shocklike manner, into engagement with the ground foot 40.

On the upper surface of the collar an additional striking force can be exerted.

Figure 2:
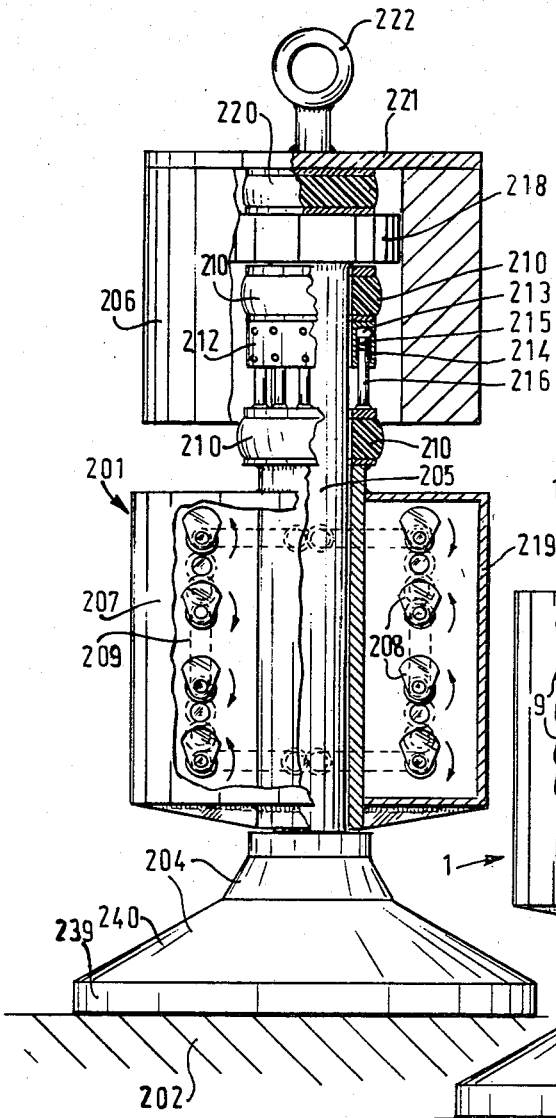
FIG. 2 is a side elevation, partly broken away view of a preferred embodiment of a device for consolidating soil in accordance with the invention.

FIG. 2 shows a preferred embodiment of a soil consolidating device 201 according to the invention. This device includes the transmission means for transferring all the above-mentioned forces to the soil 202. Such means includes a ground foot 240. The ground foot is constructed with a heavy and thick ground plate 239 which transfers the forces directly to soil 202, and ground foot 240 also includes a conical super structure 204. A column 205 stands on and is firmly connected to the ground foot. The top end of the column 205 has a collar 218 forming pushing-off means. The device 201 comprises furthermore a mass for transferring a mass load to the transmission means and which is formed by the bulk of the ground foot 240, that is, by conical super structure 204 thereof, the column 205 and an additional mass 206 supported by the column 205 via an elastic rubber cushion 220 and a plate 221. It is to be appreciated, however, that the mass of ground plate 239 may also contribute to the mass load.

The column 205 conducts and is surrounded by a housing 219 containing eccentrically rotatable masses 208 and forming a vibratory member 207, the lower end of which can be successively brought out of and in a shock-like manner into engagement with the ground foot 240.

The vibratory member 207 comprises a vibratory mass consisting of a plurality of identical, eccentrically rotatable masses 208. Under the action of driving means 209, schematically indicated by broken lines, the masses rotate in pairs with the masses in each pair rotating in opposite directions as indicated by the arrows, in a manner such that only a vertical alternating force is produced which is transferred via the ground foot 240 to the soil 202.

Under the action of its own weight as well as by spring means the vibratory member 207 is urged towards the ground plate. These spring means are formed by two rings 210 of elastic rubber. Between the two rubber rings 210 are arranged a plurality of hydraulic rams 212 forming stretching and setting means. By controlling the pressure difference between the chambers 213 and 214 of the hydraulic rams 212 on both sides of the pistons 215 the piston rods 216 are displaced. In this manner the bias tension of the elastic cushions or rings 210 can be set as directed. The hydraulic rams are distributed along the circumference of the column 205. The vibratory member 207 can start its movement in the downward direction from the collar 218. The collar 218 constitutes a limiting member co-operating via the elastic cushions 210 and the hydraulic rams 212 with the top end of the vibratory member 207. In this embodiment the limiting member is rigidly secured to the corresponding ends of the rubber cushions 210. The top side of the plate 221 is provided with an eye 222 for co-operation with a hook coupled with a hoisting system (not shown) for disposal and removal of the additonal mass 206.

The graph shown in broken lines in FIG. 5 illustrates qualitatively as a function of time the force exerted by the vibratory member 7, 207 on the soil 2, 202, when the vibratory member is fixedly coupled with the transmission means. The curve in solid lines shown on the same scale the force exerted on the soil 2, 202 by the vibratory member when it is successively brought out of and, in a shock-like manner, into engagement with the ground foot 40, 240.

Up to the instant $t_o$ such a force is produced away from the collar 218 via the rubber cushions 210 so that the ground foot 240 is exposed not only to the desired, downwardly extending force (in the Figure that part of the graph that is located beneath the t-axis) but also a force extending upwardly and not being effective for consolidation. At the instant $t=t_o$ further slackening of the cushions 210 occurs by the modification of setting of the hydraulic rams. As a result the downwardly extending force is considerably increased whereas the upwardly extending force is reduced. As compared with the case indicated by broken lines the magnitude of the downwardly extending force has increased by a factor 2 to 10.

When starting the device 201, first the housing 219 is lifted from the ground foot 240 preferably by controlling the hydraulic rams 212 so that the housing will elastically be suspended around a position of equilibrium. Subsequently the masses 208 are rotatably driven with a frequency progressively increased to a predetermined frequency so that the housing starts vibrating around the position of equilibrium. When the predetermined frequency is reached, the housing 219 is lowered by controlling the hydraulic rams 212 so that it successively is brought out of and, in a shock-like manner, into engagement with the ground foot 240. Thus, energy is transferred to the soil 202, as a result of which the vibration frequency decreases to a stationary operational value. The optimum value of this frequency depends upon the effective vibrating mass of the vibratory member 207, on the rigidity of the elastic cushions 210, 220, on the mass of the ground foot 240, the column 205, the plate 221 and the additional mass 206, as well as upon the properties of the soil to be consolidated. In practice, the setting of the hydraulic rams 212 is selected in accordance with the properties of the soil in a manner such that an optimum transfer of energy is obtained.

FIG. 6 illustrates the desirability of an increase in frequency of the vibratory member 207 in the no-load state. In the graph is plotted on the ordinate a torque M of a conventional electric motor for driving the vibratory member 207, whereas on the abscissa is plotted the number of revolutions N per given period of time.

When the initial action of the motor from the standstill (N=0) causes the vibratory member to press on the ground foot 240, the course of the graph varies from $N_o$ towards $N_{min}$, that is to say, toward the torque corresponding to a minimum number of revolutions per second. It is known that an increasing vibration frequency requires an increasing torque, whereas according to the graph, the motor torque decreases with an increase in the number of revolutions per second. If the motor cannot be sufficiently loaded to pass an additional current required for passing by $N_o$ the desired stationary operational frequency $N_{stat}$ cannot be attained. In accordance with the invention it is therefore preferred to control the motor first in the no-load state up to the frequency $N_{max}$, that is to say, the frequency corresponding to the maximum motor torque. Subsequently the load is switched on by lowering the vibratory member in the manner described above. As a result the number of revolutions per second drops to substantially the desired stationary operational value $N_{stat}$.

In the preferred embodiment of the device shown in FIG. 2, which provides an extremely satisfactory consolidation of the soil, the ground foot 240, the column 205 and the housing 219 are preferably made from steel. The ground plate having a size of $5\times5$ meters, together with the column 205, have a weight of about 60,000 kgs. The additional mass has a weight of about 50,000 kgs. The operational frequency is equal to about 10 to 100 Hz. With a frequency of 25 Hz the alternating force exerted on the soil has an effective value of the order of magnitude of $10\times10^6$ N.

Figure 3:
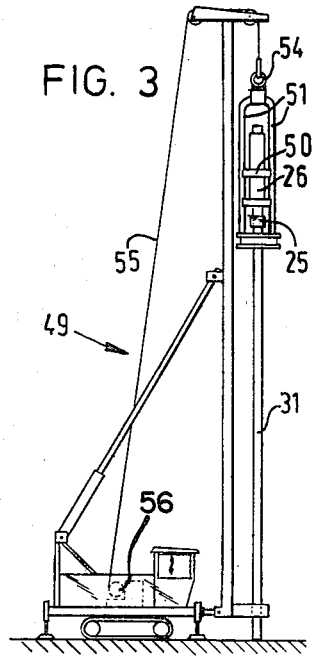
FIG. 3 is a side elevation view of a device for driving a pile into the soil in accordance with the invention.

The device 49 shown in FIG. 3, details of which are shown on an enlarged scale in FIGS. 4 and **4*a*, serves to drive a pile 31 into the soil with the aid of a device 50 in accordance with the invention. The device 50 according to the invention comprises hammer means for exerting an additional striking force on the transmission means formed by a cap 25. In the embodiment shown the hammer means is formed by a piston 24 adapted to move up and down in a cylinder 26. The piston 24 and the cylinder 26** constitute together a Diesel ram of known type. Fuel feeding means for the combustion space and the exhaust of combustion products are not shown.

The lower end of the cylinder 26 stands loosely in a slightly resilient manner on the cap 25, which surrounds the top end of the pile 31. The cylinder 26 is guided with the aid of two sets of guide members 52, 53 in a vertical sense by two vertical stay beams 51. Via a cable 55 fastened to an eyelet 54, the stay beams are positioned by a hoisting system 56 and held in an upright position.

On the pile cap loosely stands a housing 419 forming a vibratory member 407 comprising in the embodiment shown two eccentrically rotatable masses 408, the lower end of the housing being successively brought out of and, in a shock-like manner, into engagement with the guide members 52. In the embodiment shown in FIG. 4 the vibratory member 407 can move away from the set of guide members 52 via springs 59. From FIG. 4*a* it will be apparent that these springs 56 are not absolutely necessary.

The masses of the pile cap 25, the cylinder 26 and the guide members 52 exert a mass load on the pile cap 25. An additional mass load can be obtained on the pile cap 25 by an additional mass connected for example with the cylinder 26.

If desired the ram may be omitted.

The drawing does not show the embodiment in which the vibratory member 407 can start away from abuttments connected with the pile 31.

What I claim is:

1. A device for intermittently exerting thrusting forces on soil, comprising transmission means for transmitting the forces to the soil, a mass exerting a mass load on said transmission means, at least one vibratory member which is adapted to vibrate at least at a first predetermined frequency; and means for maintaining said at least one vibratory member at a first equilibrium position out of contact with said transmission means while said at least one vibratory member vibrates at said first predetermined frequency and for then moving said at least one vibratory member to a second operative position into contacting relation with respect to said transmission means when said at least one vibratory member is vibrating at said first predetermined frequency in said equilibrium position so that said at least one vibratory member moves up and down and is brought successively out of and, in a shock-like manner, into direct contacting engagement with the transmission means at a second frequency less than said first predetermined frequency when said transmission means is in contact with the soil, with no buffering means opposing the shock-like engagement between said at least one vibratory member and said transmission means, so that shock-like forces are applied to said transmission means by said at least one vibratory member.

2. A device as claimed in claim 1, comprising in addition hammering means for the exertion of at least one blow on said transmission means.

3. A device as claimed in claim 1, further comprising spring means urging the at least one vibratory member towards the transmission means.

4. A device as claimed in claim 3, in which said spring means includes at least one ring of elastic rubber material.

5. A device as claimed in claim 3, in which said spring means includes at least one cupped spring washer.

6. A device as claimed in claim 3, comprising biasing means to bias said spring means by a desired amount.

7. A device as claimed in claim 6, in which said biasing means comprise at least one hydraulic ram.

8. A device as claimed in claim 3, further comprising means for guiding the at least one vibratory member in the direction of vibration and a limiting member cooperating with the upper end of the at least one vibratory member.

9. A device as claimed in claim 8, in which the limiting member is a stop member.

10. A device as claimed in claim 9, in which the limiting member is rigidly secured to a corresponding end of the spring means.

11. A device as claimed in claim 1 for consolidating soil, in which said transmission means includes at least one ground foot.

12. A device as claimed in claim 11, in which the mass load is substantially supplied by said ground foot.

13. A device as claimed in claim 1 for driving a pile into the soil, in which said transmission means includes a pile cap.

14. A device as claimed in claim 1, in which said transmission means includes a base member, and further comprising a column mounted on said base member, and an abutment used for the take-off of the at least one vibratory member in a downward direction, said abutment being provided at the upper end of said column.

15. A device as claimed in claim 14, further comprising a housing surrounding said column, the latter of which forms a guiding member for said housing, and a plurality of eccentrically rotatable masses accommodated in the housing, said housing and said rotatable masses constituting the at least one vibratory member and the housing being adapted to be brought with its lower end successively out of and, in a shock-like manner, into engagement with the base member.

16. A device as claimed in claim 14, further comprising an additional mass mounted on top of and supported by said column.

17. A device as claimed in claim 16, further comprising an elastic rubber cushion interposed between the additional mass and the column.

18. A method of intermittently exerting thrusting forces on soil through transmission means, comprising the steps of applying a force from at least one mass load on said transmission means when the latter is in contact with said soil, vibrating at least one vibratory member in an equilibrium position out of contact with said transmission means at a first predetermined frequency, and then moving said at least one vibratory member successively out of and, in a shock-like manner, into contacting engagement with said transmission means when the latter is in contact with said soil, with no buffering means opposing the shock-like engagement between said at least one vibratory member and said transmission means, such that the frequency at which said at least one vibratory member is vibrated is reduced to a second lower frequency and shock-like forces are applied to said transmission means by said at least one vibratory member.

19. The method as claimed in claim 18, further comprising the step of exerting at least one blow produced by an additional striking force on the transmission means.

20. The method as claimed in claim 18, in which the forces applied by said at least one mass load and said at least one vibratory member are exerted on the soil through the transmission means and a pile to be driven into the ground.

21. The method as claimed in claim 18, in which spring means are used for at least a part of the shockwise action of the at least one vibratory member on the transmission means.

22. The method as claimed in claim 18, in which said first predetermined frequency corresponds to a frequency of rotation of a motor used to produce maximum motor torque.

23. A device for intermittently exerting thrusting forces on soil, comprising transmission means for transmitting the forces to the soil and including a base member, a column mounted on said base member, a mass exerting a mass load on said transmission means, at least one vibratory member which is adapted to move up and down and to be brought successively out of and, in a shock-like manner, into engagement with the transmission means, with no buffering means opposing the shock-like engagement between said at least one vibratory member and said transmission means, a column mounted on said base member, said at least one vibratory member including a housing surrounding said column, the latter of which forms a guiding member for said housing, and a plurality of eccentrically rotatable masses accomodated in the housing, and the housing having a lower end adapted to be brought successively out of and, in a shock-like manner, into engagement with the base member, an abutment provided at the upper end of said column and used for take-off of the at least one vibratory member in a downward direction, said abutment including a collar secured to the column, and at least one rubber ring and at least two equiangularly spaced hydraulic rams provided around the column, said at least one ring and said rams forming a connection between the at least one vibratory member and said collar.

* * * * *